US005614274A

United States Patent [19]

Huss

[11] Patent Number: 5,614,274

[45] Date of Patent: Mar. 25, 1997

[54] PREFORMED SELF-ADHERING BOW

[75] Inventor: Charles P. Huss, Stillwater, Minn.

[73] Assignee: Minnesota Mining and Manufacturing Company, St. Paul, Minn.

[21] Appl. No.: 659,452

[22] Filed: Jun. 6, 1996

Related U.S. Application Data

[63] Continuation of Ser. No. 153,373, Nov. 16, 1993, abandoned.

[51] Int. Cl.[6] ..... D04D 7/10

[52] U.S. Cl. ..... 428/5; 28/147; 223/46

[58] Field of Search ..... 428/4, 5, 101; 28/147; 223/46

[56] References Cited

U.S. PATENT DOCUMENTS

| | | | |
|---|---|---|---|
| 1,276,731 | 8/1918 | Crowell | 428/258 |
| 2,072,095 | 3/1937 | Cohn | 428/193 |
| 2,153,310 | 4/1939 | Newman | 24/17 R |
| 2,248,317 | 7/1941 | Van Cleef | 206/447 |
| 2,278,673 | 4/1942 | Savada et al. | 428/42 |
| 2,450,083 | 9/1948 | Donaldson | 428/40 |
| 2,586,039 | 2/1952 | Heggdal | 428/79 X |
| 2,626,883 | 1/1953 | Boese | 428/4 X |
| 2,641,562 | 6/1953 | Chartrand et al. | 428/40 |
| 2,849,821 | 9/1958 | Doig | 428/5 |
| 2,880,862 | 4/1959 | Sermattei | 428/40 |
| 3,011,988 | 12/1961 | Luedke et al. | 428/514 X |
| 3,241,662 | 3/1966 | Robinson et al. | 428/343 |
| 3,256,129 | 6/1966 | Wallerstein et al. | 428/5 |
| 3,447,954 | 6/1969 | Lohse | 427/208.2 |
| 3,468,744 | 9/1969 | Reinhart | 428/520 |
| 3,475,259 | 10/1969 | Meserole | 428/189 |
| 3,479,243 | 11/1969 | Doig | 428/5 |
| 3,632,464 | 1/1972 | Grikis | 428/4 |
| 3,637,455 | 1/1972 | Pearson et al. | 428/4 |
| 3,691,140 | 9/1972 | Silver | 526/240 |
| 3,857,731 | 12/1974 | Merrill et al. | 428/314.4 |
| 3,922,407 | 11/1975 | Nimmo, Jr. et al. | 428/5 |
| 3,922,464 | 11/1975 | Silver et al. | 428/355 |
| 3,954,212 | 5/1976 | Bolis | 223/46 |
| 4,138,527 | 2/1979 | Malek | 428/425 |
| 4,151,319 | 4/1979 | Sackoff et al. | 428/40 |
| 4,166,152 | 8/1979 | Baker et al. | 428/522 |
| 4,329,382 | 5/1982 | Truskolaski et al. | 428/4 |
| 4,390,576 | 6/1983 | Hutter, III | 428/99 X |
| 4,421,817 | 12/1983 | Pina et al. | 428/207 |
| 4,476,168 | 10/1984 | Aoyama | 428/4 |
| 4,515,837 | 5/1985 | Cheng | 428/4 |
| 4,576,854 | 3/1986 | Kurahashi | 428/204 |
| 4,585,676 | 4/1986 | DeSmet | 428/5 |
| 4,634,612 | 1/1987 | Nelson et al. | 428/4 |
| 4,670,012 | 6/1987 | Johnson | 604/390 |
| 4,680,210 | 7/1987 | Corcoran | 428/42 |
| 4,684,552 | 8/1987 | LaBrosse et al. | 428/4 |
| 4,696,854 | 9/1987 | Ethier | 428/287 |
| 4,708,907 | 11/1987 | Flutti et al. | 428/352 |
| 4,713,267 | 12/1987 | Truskolaski | 428/4 |
| 4,724,175 | 2/1988 | LaBrosse et al. | 428/4 |
| 4,725,461 | 2/1988 | Masui | 428/24 X |
| 4,735,837 | 4/1988 | Miyasaka et al. | 428/40 |
| 4,770,320 | 9/1988 | Miles et al. | 221/33 |
| 4,781,306 | 11/1988 | Smith | 221/33 |
| 4,812,338 | 3/1989 | Masui | 428/4 |
| 4,822,670 | 4/1989 | Ono et al. | 428/317.3 |
| 4,826,712 | 5/1989 | Theno | 428/4 |

(List continued on next page.)

FOREIGN PATENT DOCUMENTS

| | | |
|---|---|---|
| 0248113A3 | 12/1987 | European Pat. Off. . |
| 0439941A1 | 8/1991 | European Pat. Off. . |
| 0443263A2 | 8/1991 | European Pat. Off. . |
| 218171 | 5/1986 | New Zealand . |

*Primary Examiner*—Henry F. Epstein

*Attorney, Agent, or Firm*—Gary L. Griswold; Walter N. Kirn; James J. Trussell

[57] ABSTRACT

A preformed self-adhering bow having a preformed bow member and at least one application band attached to the bow member. The at least one application band includes a layer of a pressure sensitive adhesive for adhering the bow to an object.

24 Claims, 9 Drawing Sheets

U.S. PATENT DOCUMENTS

| | | | |
|---|---|---|---|
| 4,842,303 | 6/1989 | Molenda | 281/38 |
| 4,907,825 | 3/1990 | Miles et al. | 281/51 |
| 4,915,996 | 4/1990 | Curry | 428/40 |
| 4,968,562 | 11/1990 | Delgado | 428/402 |
| 4,988,567 | 1/1991 | Delgado | 428/402 |
| 4,994,322 | 2/1991 | Delgado et al. | 428/343 |
| 5,015,520 | 5/1991 | Vaccari | 428/215 |
| 5,026,578 | 6/1991 | Iname | 428/4 |
| 5,032,436 | 7/1991 | Gustafson | 428/14 |
| 5,045,569 | 9/1991 | Delgado | 521/60 |
| 5,053,436 | 10/1991 | Delgado | 521/64 |
| 5,073,457 | 12/1991 | Blackwell | 428/484 |
| 5,114,761 | 5/1992 | Doherty | 428/4 |
| 5,118,750 | 6/1992 | Silver et al. | 524/462 |
| 5,153,041 | 10/1992 | Clements et al. | 428/40 |
| 5,192,612 | 3/1993 | Otter et al. | 428/355 |
| 5,194,299 | 3/1993 | Fry | 427/208.6 |
| 5,244,701 | 9/1993 | Saigo et al. | 428/4 |
| 5,392,983 | 2/1995 | Clarke-Bolling et al. | 428/4 X |
| 5,468,523 | 11/1995 | Huss et al. | 428/5 |

PREFORMED SELF-ADHERING BOW

This is a continuation of application Ser. No. 08/153,373 filed on Nov. 16, 1993 and now abandoned.

FIELD OF THE INVENTION

This invention relates generally to preformed bows.

BACKGROUND OF THE INVENTION

Designs for prefabricated bows are known in the art. Such bows 10 may be constructed of a ribbon or ribbon like material with a bow member 11 having a plurality of loops 12 mutually secured to each other (such as by staple 13) at a common location to form a base portion 14, as shown in FIGS. 1 and 2. The number, size and relative locations of the loops 12 enable a variety of desired bow forms to be achieved.

In some instances, such preformed bows are provided with a stiffening sheet 15, constructed of a suitable material such as paperboard, commonly attached (conveniently such as by staple 13 with the loops 12) to the base portion 14 of the bow, as shown specifically in FIG. 2. A length of pressure sensitive adhesive tape (not shown) may be used to secure the preformed bow to the package. However, this approach is not entirely convenient in that it requires separate provision of a length of the pressure sensitive adhesive tape to secure the bow to an object. Also, the tape may be visible and detract from the visual appearance of the package.

Alternatively, the stiffening sheet 15 may conveniently be provided with a layer of pressure sensitive adhesive 16 on the surface 17 of the stiffening sheet directed away from the bow base portion 14. The layer of pressure sensitive adhesive is typically covered by a removable liner 18 prior to use. The exposed pressure sensitive adhesive may be employed to adhere the bow to an object, such as a gift package.

In the past, such pressure sensitive adhesives have been "permanent" adhesives in that after application to a surface and a relatively short "dwell time", the bow can not be removed from the package without causing damage to the bow or the package or both. This prevents repositioning or reuse of the bow.

Frequently, it is also desirable to secure a ribbon band to the gift package in a convenient arrangement in conjunction with a preformed bow. configuring a gift package in this manner requires that a preformed bow be provided and then attached to the package, and then that a length of the ribbon be provided and separately attached to the gift package. Similarly, if separate lengths of pressure sensitive adhesive tape are required to be provided to secure the ribbon to the gift package, convenience is reduced and the ribbon may not be conveniently repositioned with respect to the package or to the bow.

It has also been known to attach (such as by staple 13 with loops 12 and stiffening sheet 15) a length of ribbon 19 at an intermediate point to an alternate form 10' of a preformed bow, to facilitate in the attachment of the bow to an object, as shown in FIGS. 3 and 4. As previously described, this requires the provision of separate means, such as a length of pressure sensitive adhesive tape (not shown), to secure the bow 10' and ribbon 19 combination to an object.

Designs for self-forming bows, referred to as "Pull Bows" are known in the art as an alternative to the preformed bows shown in FIGS. 1–4. Such self forming bows are disclosed in U.S. Pat. Nos. 3,637,455; 3,954,212; 4,329,382; 4,476,168 and 4,515,837, the contents of which are incorporated herein by reference. As shown in FIGS. 5–7, such pull bows 20 have included two ribbon bands **21*a*, 21*b*. A pair of drawstrings 22*a*, 22*b*** are interposed between the ribbon bands.

First ends of the drawstrings **21*a*, 21*b* are bonded to each other and to the ribbon bands 22*a*, 22*b* adjacent one end of the ribbon bands (as at 24). The ribbon bands are also bonded to each other at spaced paired locations 26 on either side of the drawstrings. Pairs of the bonded locations 26 on the ribbon bands on opposing sides of the drawstrings form "fold lines" 30 that act to form loops (as at 32 in FIGS. 6 and 7) in the ribbon bands when the second, opposite ends 34, 36 of the drawstrings 21*a*, 21*b* are grasped and pulled in direction 38 while the ribbon bands are held stationary or pushed in the opposite direction 40 (as shown in FIG. 6). When the fold lines and resulting loops are gathered adjacent first ends (at 24 and as shown in FIG. 7), a bow member 42** is fully formed and the drawstrings extend therefrom.

Referring now again to FIG. 5, if a fold line 30 is transverse to the length of the ribbon bands, (as at **30*a*) the resulting loops 32 are aligned with each other and the ribbon bands, resulting in bows available from the Minnesota Mining and Manufacturing Co. of St. Paul, Minn. under the trademark "Tiara". In U.S. Pat. No. 4,476,168, issued to Aoyama, fold lines 30 (as at 30*b* in FIG. 5**) are disclosed that were inclined with respect to the ribbon bands. This resulted in bows being formed having loops that may be inclined with respect to the drawstrings. Bows having inclined fold lines are available from the Minnesota Mining and Manufacturing Co. of St. Paul, Minn. under the trademarks "Pom" and "Regal". Of course, other alternate bow designs may be devised and are known in the art by arranging the number, angle and position of the various fold lines.

FIG. 7A illustrates one apparatus and method for constructing a conventional prefabricated self-forming pull bow as shown in FIGS. 5–7. Drawstring webs **21*a* and 21*b* are drawn from supply rolls 50 and 52, respectively generally in direction 54 and pass through aligned nip rollers 56 and 58. Ribbon bands 22*a* and 22*b* are drawn from supply rolls 60 and 62, respectively and pass though aligned nip rollers 64 and 66, with the drawstrings interposed between the ribbon bands. At least three bonding members 70 are provided (only one of which is shown in FIG. 7**A). One is generally aligned with each longitudinal edge of the ribbon bands, and another is transversely positioned at a medial location.

The bonding members 70 are periodically actuated in a manner known in the art to form bonded locations 26 along the longitudinal edges of the ribbon bands on other side of the drawstrings, or at a medial location 24 to establish the first ends of the bows, as shown in FIG. 5, supported by platform 72. The location and spacing of the bonded location may be predetermined to construct a bow having the desired size and formation, as previously discussed.

Severing means are provided in the form of knife 74 to sever each prefabricated self-forming pull bow from the bonded continuous web. Typically, the knife forms a chevron shaped division (as shown in FIGS. 5 and 7) between the respective first ends and the second ends of sequential bows. Each severed bow 20 is sequentially received within receptacle 76.

Once a bow is formed, as shown in FIG. 7, the extended drawstrings **21*a*, 21*b*** may be tied together about an object (not shown), such as a package, to secure the bow in place. However, this approach may not adequately secure the bow to the object. Furthermore, the bow may not be conveniently removable without cutting the drawstrings, hampering reuse. Alternatively, segments of pressure sensitive adhesive tape (not shown) may be applied to the drawstrings to secure the drawstrings, and thus the bow, to the object. Using segments of pressure sensitive adhesive tape while holding the bow in position on an object is not desirable, as previously discussed.

It is also known from U.S. Pat. Nos. 4,826,712, and 2,278,673, to provide a decorative ribbon having a coating of pressure sensitive adhesive on a surface thereof. The '673 patent discloses that a pressure sensitive adhesive may be utilized that is removable from a surface, and the '712 patent discloses that a pressure sensitive adhesive may be utilized that is repositionable with respect to the surface. However, neither of these patents suggests the use of such pressure sensitive adhesive coated ribbons in conjunction with either a preformed or a self forming bow.

Co-pending U.S. patent application Ser. No. 08/031,560, filed Mar. 15, 1993 and entitled "Method and Apparatus for Forming Prefabricated Self-forming Self-adhering Pull Bow and Pull Bow Formed Thereby" issued as U.S. Pat. No. 5,468,523, discloses a pull bow that is similar in structure and operation as the conventional pull bows described herein and as shown in FIGS. 5–7. However, in the pull bow disclosed in the Ser. No. 08/031,560 application, at least a portion of the facing major surfaces of the drawstrings have a layer of a pressure sensitive adhesive coated thereon so as to adhere the drawstrings to each other, wherein the drawstrings may be separated after the bow is formed and the exposed layers of pressure sensitive adhesive applied to an object to adhere the bow to the object. Preferably, the pressure sensitive adhesive is a repositionable pressure sensitive adhesive, so that once formed, the pull bow may be applied to an object, such as a package, and then removed and reapplied without damage to the package or the bow. Means may be provided to facilitate the separation of the reciprocally adhered drawstrings for application of the pressure sensitive adhesive coated surfaces to an object.

However, none of the above bows, whether preformed or self-forming, adequately addresses the problem of quickly and conveniently securing a preformed bow to a package.

SUMMARY OF THE INVENTION

The present invention provides a preformed self-adhering bow for application to an object. The preformed self-adhering bow includes a preformed bow member including a plurality of bow loops interconnected at a base portion. At least one application band is provided having a first end and an opposing second end, and a first major surface, with at least a portion of the first major surface of the at least one application band having a layer of a pressure sensitive adhesive coated thereon. Means are provided for attaching the at least one application band to the base portion of the bow member. The exposed layer of pressure sensitive adhesive on the first major surface of the at least one application band enables the bow to be adhered to the object.

In one embodiment of the present invention, a pair of application bands are provided. The pair of application bands are attached to the base portion of the bow member adjacent the respective first ends thereof, with the respective first major surfaces in facing relationship and reciprocally adhered. The application bands may be separated and the exposed layers of pressure sensitive adhesive applied to the object to adhere the bow to the object.

In another embodiment of the invention, a single application band is provided and attached to the bow member at a location intermediate the first and the second ends thereof. The layer of pressure sensitive adhesive on the first major surface is directed away from the bow member of the bow for application to the object to adhere the bow to the object.

In another embodiment of the invention, the layer of pressure sensitive adhesive on the at least one application band is a repositionable pressure sensitive adhesive, wherein the bow may be removed from a package by detaching the at least one pressure sensitive adhesive coated application band from the package without damage to the bow or the package.

BRIEF DESCRIPTION OF THE DRAWINGS

The present invention will be more thoroughly described with reference to the accompanying drawing in which like numbers refer to like parts in the several views, and wherein.

DETAILED DESCRIPTION OF THE INVENTION

Figure 1:
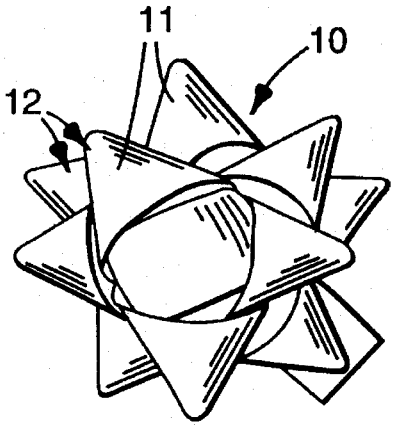
Fig. 1 PRIOR ART
FIG. 1 is a plan view of a conventional preformed bow.
Figure 2:
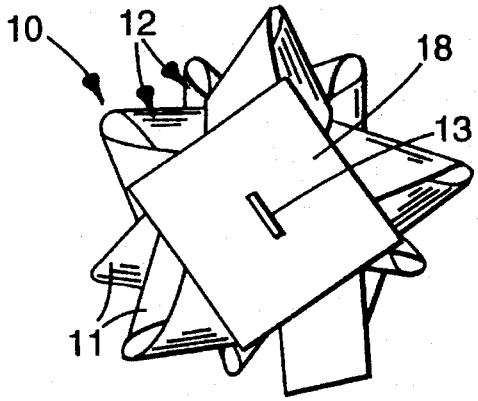
Fig. 2 PRIOR ART
FIG. 2 is a bottom view of the conventional preformed bow of FIG. 1.
Figure 2A:
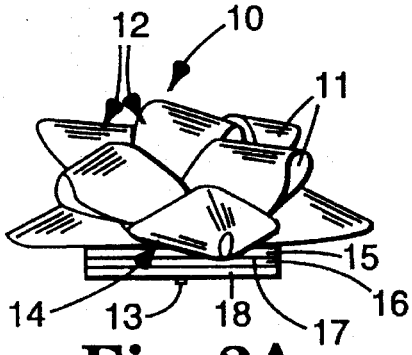
Fig. 2A PRIOR ART
FIG. 2A is a magnified partial side view of the base portion and stiffening sheet of the preformed bow of FIG. 2.
Figure 3:
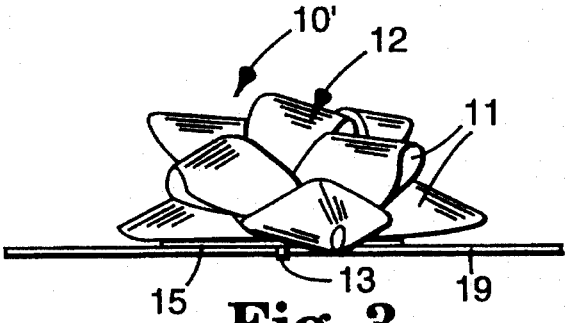
Fig. 3 PRIOR ART
FIG. 3 is a side view of a conventional preformed bow with a ribbon band attached thereto for securing the bow to an object.
Figure 4:
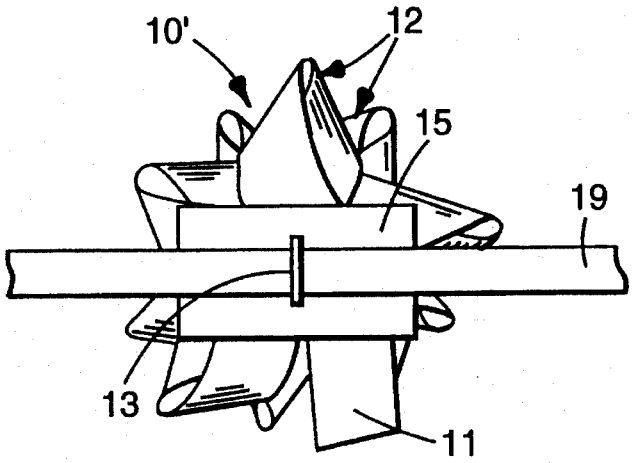
Fig. 4 PRIOR ART
FIG. 4 is a bottom view of the conventional preformed bow of FIG. 3.
Figure 5:
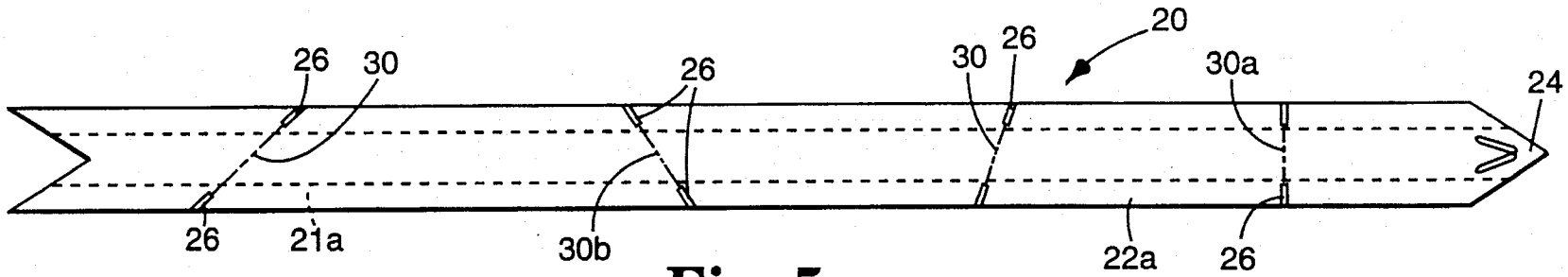
Fig. 5 PRIOR ART
FIG. 5 is a plan view of a conventional self-forming pull bow.
Figure 6:
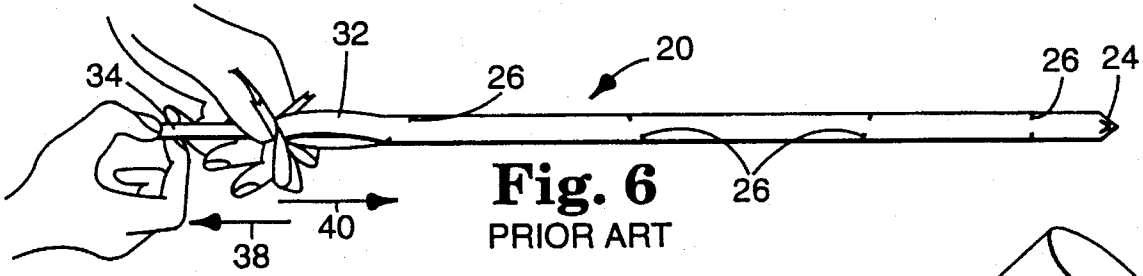
Fig. 6 PRIOR ART
FIG. 6 is a plan view of the self-forming bow of FIG. 5, partially formed into a bow.
Figure 7:
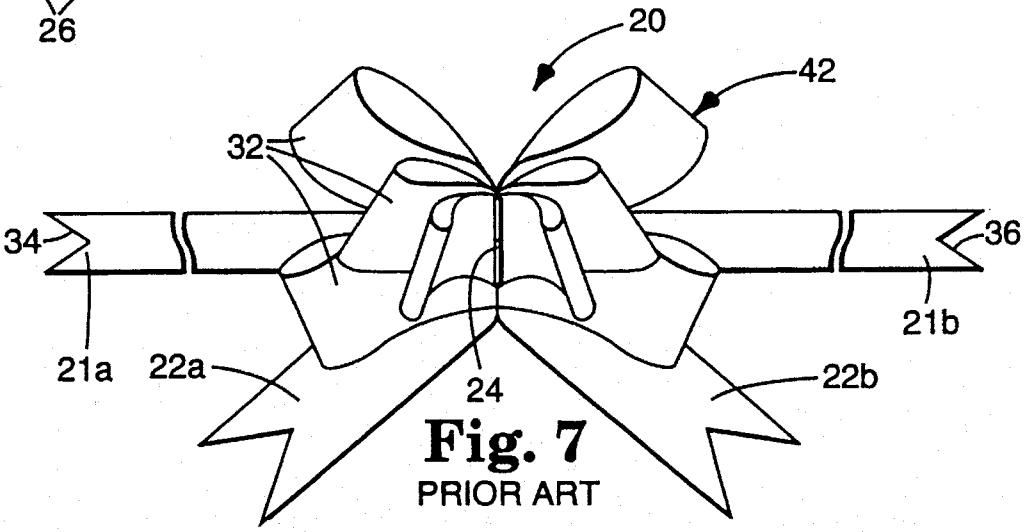
Fig. 7 PRIOR ART
FIG. 7 is a plan view of a fully formed self-forming bow.
Figure 7A:
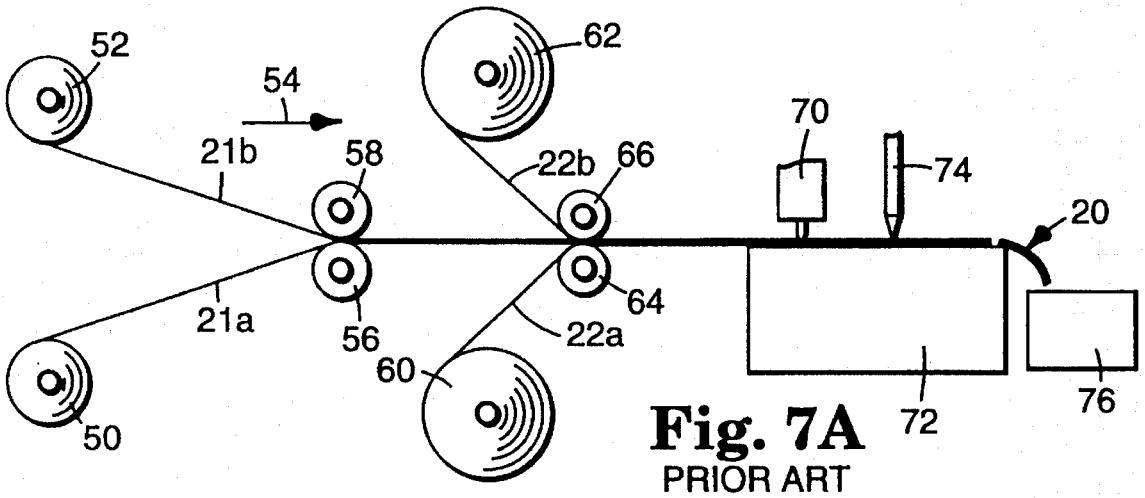
Fig. 7A PRIOR ART
FIG. 7A is a schematic representation of a method and apparatus for forming the self forming bow of FIGS. 5–7.
Figure 8:
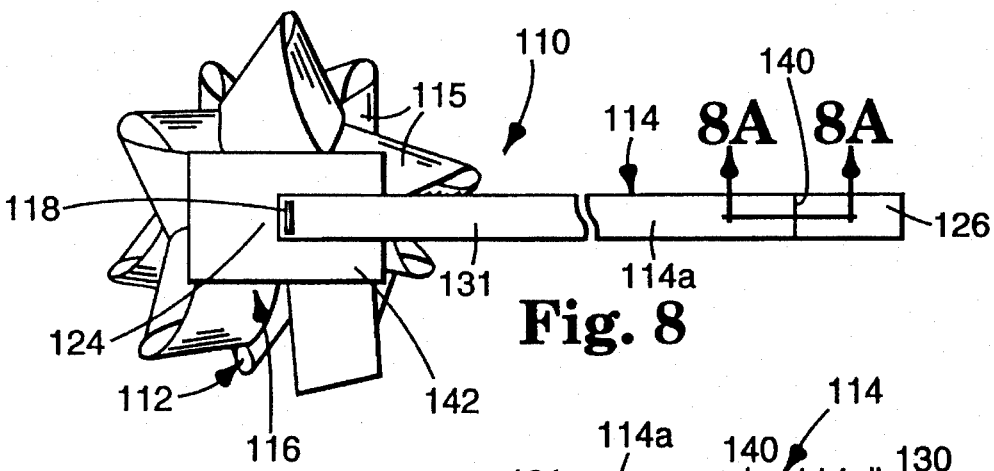
FIG. 8 is a bottom view of a preformed self-adhering bow according to the present invention having a pair of reciprocally adhered pressure sensitive adhesive coated application bands attached thereto.
Figure 8A:
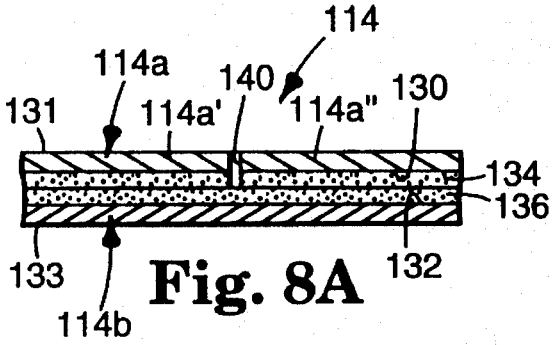
FIG. 8A is a magnified cross sectional view of a portion of the reciprocally adhered pressure sensitive adhesive coated application bands of FIG. 8, with a weakened line formed in one of the application bands for facilitating the separation of the application bands.
Figure 8B:
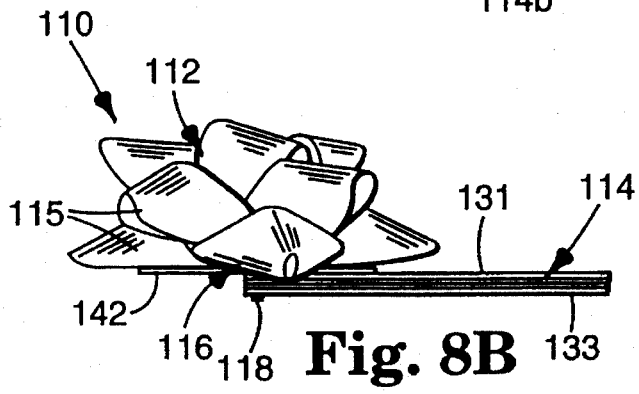
FIG. 8B is a partial side view of the preformed bow and pressure sensitive adhesive coated application bands of FIG. 8.

Referring now to FIGS. 8,8A, and 8B, there is shown a preformed self-adhering bow 110 according to the present invention. The bow 110 includes a bow member 112 and one or more application bands 114. The bow member 112 is constructed of a plurality of loops 115 commonly joined together at a base portion 116. Preferably, the loops 115 are formed from a single continuous length of a ribbon material. For the purposes of this invention, the term "ribbon" shall include any woven, non-woven or film material formed into a flexible narrow strip. However, it will be recognized that the bow member could be constructed from a plurality of loops formed of separate lengths of ribbon material (not shown) that are similarly commonly joined at at least one end of each length, and preferably at both ends, to form a base portion.

Although the ribbon could be constructed of any suitable ribbon material, the following is a non-exclusive list of the preferred materials: polymeric films such a polyethylene, polypropylene, foamed polypropylene, paper, styrene, cellulose acetate, polyester, nylon and the like; woven and nonwoven fabrics; and decorative sheet materials such as those disclosed in U.S. Pat. Nos. 4,634,612 and 4,713,257, the contents of which are incorporated herein by reference. Most preferably, the ribbon materials are pigmented polypropylene, foamed pigmented polypropylene, and the aforementioned decorative sheet materials. Ribbon materials suitable for use in constructing the self-adhering bows of the present invention are available from the Minnesota Mining and Manufacturing Co. of St. Paul, Minn. under the trademarks "Sasheen" or "Decosheen".

Means are provided to commonly join the loops of ribbon material. In the illustrated embodiment, the joining means includes a staple 118. Alternatively, the ribbon loops may be joined by any suitable arrangement, such as clips, or heat-bonded together. The term "heat bonded" includes such techniques as heating rolls, heat staking, heat guns, sonic sealers, ultrasonic welders, lasers, and laminators or the like.

The at least one application band 114, in the embodiment illustrated in FIG. 8, includes a pair of application bands 114*a* and 114*b*. Each application band 114*a*, 114*b* includes a first end 124 and a second end 126. In the illustrated embodiment, the application bands 114*a*, 114*b* are substantially the same in length from the respective first ends to the respective second ends.

The application bands are also constructed of a ribbon material, as defined and described herein. Most preferably, the application bands are constructed of the same ribbon material as the bow member 112.

Means are provided to attach the application bands to the base portion of the bow member. In the preferred embodiment of the invention, the application bands are attached adjacent their respective first ends to the base portion by the same staple 118 that secures the loops of the bow member to each other. Alternatively, the application bands may be attached to the bow member by any suitable arrangement, such as clips, or heatbonding.

Facing major surfaces 130 and 132 of bands 114*a*, 114*b* respectively, are each coated with a layer 134, 136, respectively, of a pressure sensitive adhesive along at least a portion, and preferably the entire length and width of the facing surfaces of the bands. The layers of pressure sensitive adhesive 134,136 may be of any suitable type of pressure sensitive adhesive that permits the bands to be conveniently separated after the bow is formed, and then applied to an object. Such adhesives include rubber resin pressure sensitive adhesives, acrylate pressure sensitive adhesives, synthetic block copolymers, pressure sensitive adhesives, and the like.

Preferably, the pressure sensitive adhesive is a repositionable adhesive and enables the bands to be removed from a surface without damage to the surface or the bands. Such "repositionable" pressure sensitive adhesives are manufactured by Minnesota Mining and Manufacturing Company of St. Paul, Minn., and applied to products marketed under the "Post-it" trademark. Examples of repositionable adhesives include the microsphere pressure sensitive adhesives disclosed in U.S. Pat. Nos. 3,691,140; 3,857,731; 4,166,152; 4,968,562; 5,045,569; and 5,118,570; and European Patent No. 439,941; the block copolymer adhesive disclosed in European Patent No. 443,263, and the acrylate composition disclosed in U.S. Pat. No. 5,073,457; all incorporated herein by reference.

Most preferably, the adhesive is a repositionable discontinuous pressure sensitive adhesive such as a microsphere pressure sensitive adhesive. Such an adhesive may include solid microspheres, hollow microspheres or a combination thereof. The preferred repositionable pressure sensitive adhesive comprises about 5 to 50 percent by weight of microspheres in a solvent. The microspheres are solid, infusible, solvent-dispersible, solvent-insoluble pressure sensitive microspheres made from a copolymer of from 90 to 99.5 percent by weight of at least one alkyl acrylate ester, such as 2-ethylhexyl acrylate, isooctyl acrylate, 2-methylbutyl acrylate, and the like; and about 10 to 0.5 percent by weight of maleic anhydride or at least one ionic co-monomer that is substantially oil-insoluble and water soluble, such as sodium methacrylate, ammonium acrylate, sodium acrylate, acrylic acid, and the like.

The layers 134, 136 of pressure sensitive adhesive may be coated on the bands utilizing any suitable coating process such as extrusion, die or transfer roll coating or, in the alternative, a pressure sensitive adhesive may be sprayed such as from an aerosol container or applied as an adhesive transfer tape (such as the No. 951 pressure sensitive adhesive tape available from the Minnesota Mining and Manufacturing Company of St. Paul, Minn.) or double coated pressure sensitive adhesive tape (such as the 665 and 9424 double coated pressure sensitive adhesive tapes available from the Minnesota Mining and Manufacturing Company of St. Paul, Minn.) adhered to the facing surfaces of the bands. The 665 and 9424 pressure sensitive adhesive tapes are examples of tapes that include different pressure sensitive adhesives coated on opposite sides of the tape backing. The two adhesives have a relatively low level of adhesion to each other, and enables the tapes to be provided in roll form without a release liner interposed between the facing layers of the different adhesives. This enables the bow of the present invention to be constructed without a liner interposed between the facing surfaces of the bands if the tape is applied to the bands with different adhesives facing each other, as described in regard to another embodiment of the present invention shown in FIG. 13. However, the different adhesives adhere aggressively to a surface to which the bands are applied. Of course, the different pressure sensitive adhesives may be coated directly on the facing surfaces of the bands with the advantages described above.

The bands **114*a*,114*b* may also be coated with a layer of a primer material (not shown) disposed between the pressure sensitive adhesive layers 134,136 and the surfaces 130,132, respectively, to enhance the adhesion of the pressure sensitive adhesive to the band material. Useful primers include zinc oxide in a resin binder, as described in U.S. Pat. No. 4,822,670, the contents of which are incorporated herein by reference, chlorinated polyolefins, and phenolic resins. Corona treatment may also be applied to surfaces 130,132** of the bands to enhance adhesion of the adhesive to the ribbon material. The choice of the primer depends upon the material that the bands are composed of and the pressure sensitive adhesive to be applied.

The band material may also be coated with a layer (not shown) of a low adhesion backsizing material on the surfaces 131,133 opposite the pressure sensitive adhesive coated surfaces 130,132. Useful low adhesion backsizing materials include polyorganosiloxanes, fluorosilicones, epoxypolysiloxanes, and the like. Such low adhesion backsizing layers facilitate the winding of the pressure sensitive adhesive coated application band web into roll form, and subsequent unwinding in the construction of the self-adhering bow of the present invention, but otherwise does not affect the structure or operation of this invention.

In some cases, a protective coating may be used on the bands to prevent the yarns from pulling away from the ribbon. Useful coatings include the acrylic terpolymers and tetrapolymers disclosed in U.S. Pat. No. 3,011,988, the contents of which are incorporated herein by reference.

It is possible to manually separate the facing surfaces 130 and 132 of the application bands **114*a*, 114*b* containing the layers of pressure sensitive adhesive 134,136. However, it is preferable to provide means to facilitate convenient separation of the reciprocally adhered pressure sensitive adhesive layers of the application bands in order to apply the exposed pressure sensitive adhesive layers 134,136** to an object.

One embodiment of the separation means is illustrated in FIGS. 8 and 8A, wherein a weakened line 140 is formed in one of the application bands (application band **114*a* as illustrated). This divides application band 114*a* into two portions, a main portion 114*a*' and a shorter portion 114*a*" adjacent second ends (at 126) of the bands. The weakened line 140 may take the form of a score line, a cut in the band, a perforated line, or any other equivalent structure that enables one of the application bands to be divided at the desired location. In the preferred embodiment of the invention, the weakened line takes the form of a transverse cut through the thickness of the application band 114*a***.

Separation of the application bands **114*a*,114*b* is accomplished by convexly flexing band 114*a* to enable manual engagement with the end of main segment 114*a*' of application band 114*a*. The other portion 114*a*" masks the underlying pressure sensitive adhesive layer of application band 114*b* and may also be grasped to separate the application bands, with segment 114*a*" preferably being subsequently removed and disposed. In the most preferred embodiment of the invention, the segment 114*a*" may be removed prior to separation of the application bands from each other, to, in effect, provide application bands of unequal length, similar to that shown in FIG. 12**B.

In one embodiment of the invention (as shown in FIGS. 8A and 8B), an optional stiffening sheet 142 is attached to the base portion of the bow to provide support for the bow and facilitate attachment of the bow to an object and to attach the at least one application band to the bow member. As shown, the stiffening sheet 142 is interposed between the base portion of the bow member and the application bands **114*a*,114*b*. Preferably, the stiffening sheet is commonly attached to the bow member by staple 118 with the application bands 114*a*,114*b***.

Figure 9:
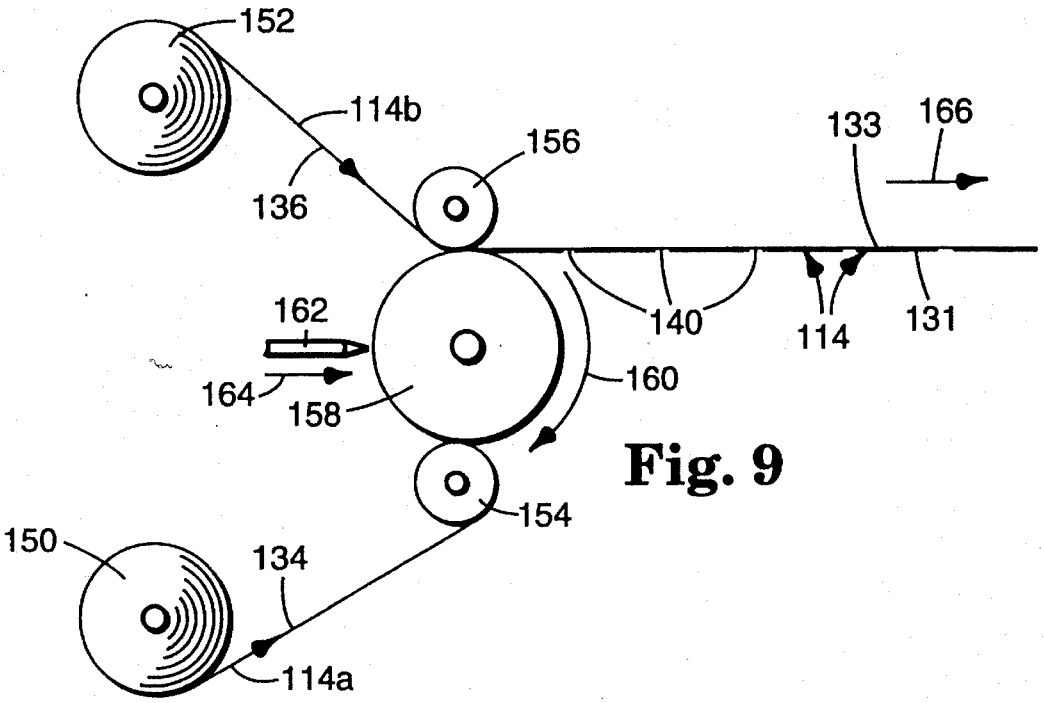
FIG. 9 is a schematic representation of a method and apparatus for forming the reciprocally adhered pressure sensitive coated application bands with a weakened line formed in one of the application bands.

FIG. 9 illustrates an apparatus and a method for constructing a prefabricated self-adhering bow according to the embodiment shown in FIGS. 8,8A and 8B. A pair of continuous application band webs **114*a*,114*b*, each coated with a layer of pressure sensitive adhesive 134 and 136, as previously described, are supplied by supply rolls 150 and 152, respectively, to roller 158 rotating in direction 160. First nip roller 154 directs application band web 114*a* about roller 158 in rotational direction 160. Application band web 114*a* is brought into alignment and contact with band 114*b* at second nip roller 156, with both pressure sensitive adhesive layers 134,136 facing each other so that the application bands are reciprocally adhered to each other and are conveyed in direction 166**.

Formation of the weakened line is accomplished in the illustrated embodiment by knife 162 or the like positioned adjacent application band web 114*a* and is periodically actuated by a mechanism (not shown) to move in direction 164 into contact with application band 114*a* to form a transverse cut in the application band web 114*a* at desired intervals. Roller 158 takes the form of a vacuum wheel along its peripheral surface, so that the severed application band web is conveyed and held in position in rotational direction 160 until the application band web 114*b* is encountered at nip roller 156. The combined application bands 114*a*, 114*b* are thereafter conveyed in direction 166 and subsequent attachment to the preformed bow as hereinelsewhere described.

Figure 10:
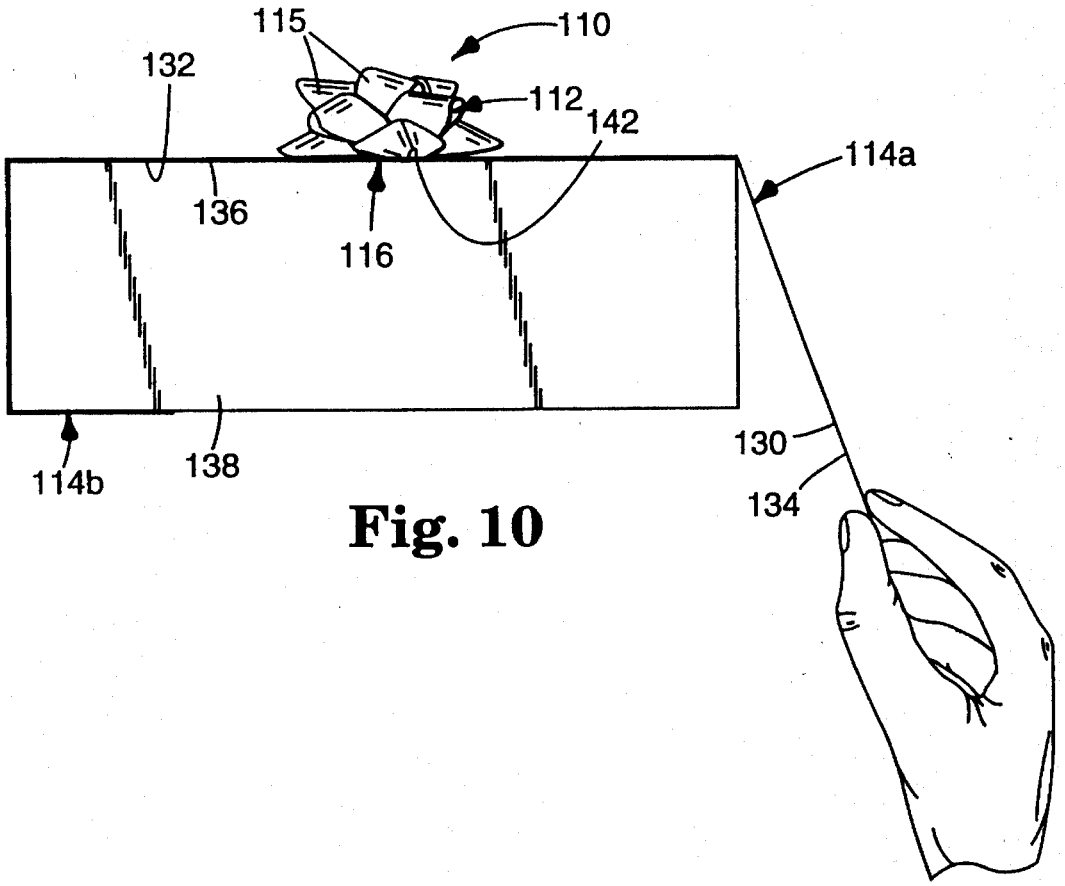
FIG. 10 is a side view of the preformed self-adhering bow and pressure sensitive adhesive bands of FIG. 8 with the bands separated and partially applied to an object.

FIG. 10 illustrates the application of the bow to an object, such as gift package 138, after separation of the reciprocally adhered application bands 114*a*,114*b*, as described herein. The adhesive coated surfaces 130, 132 are each applied to the package, with the bow positioned at a desired location. In the preferred embodiment of the invention, the pressure sensitive adhesive layer of the application bands is a repositionable pressure sensitive adhesive. This enables the bow to be removed from the package and either reused or repositioned with respect to the same package.

Figure 11:
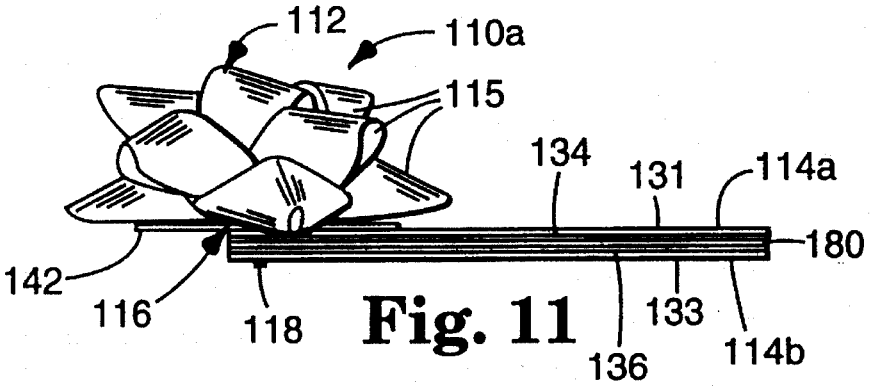
FIG. 11 is a partial side view of an alternate embodiment of the present invention with a release liner interposed between the facing major surfaces of the bands and the stiffening sheet interposed between the application bands and the base portion of the bow.
Figure 11A:
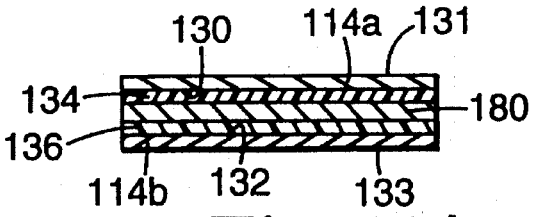
FIG. 11A is a cross sectional view of the application bands of FIG. 11.
Figure 11B:
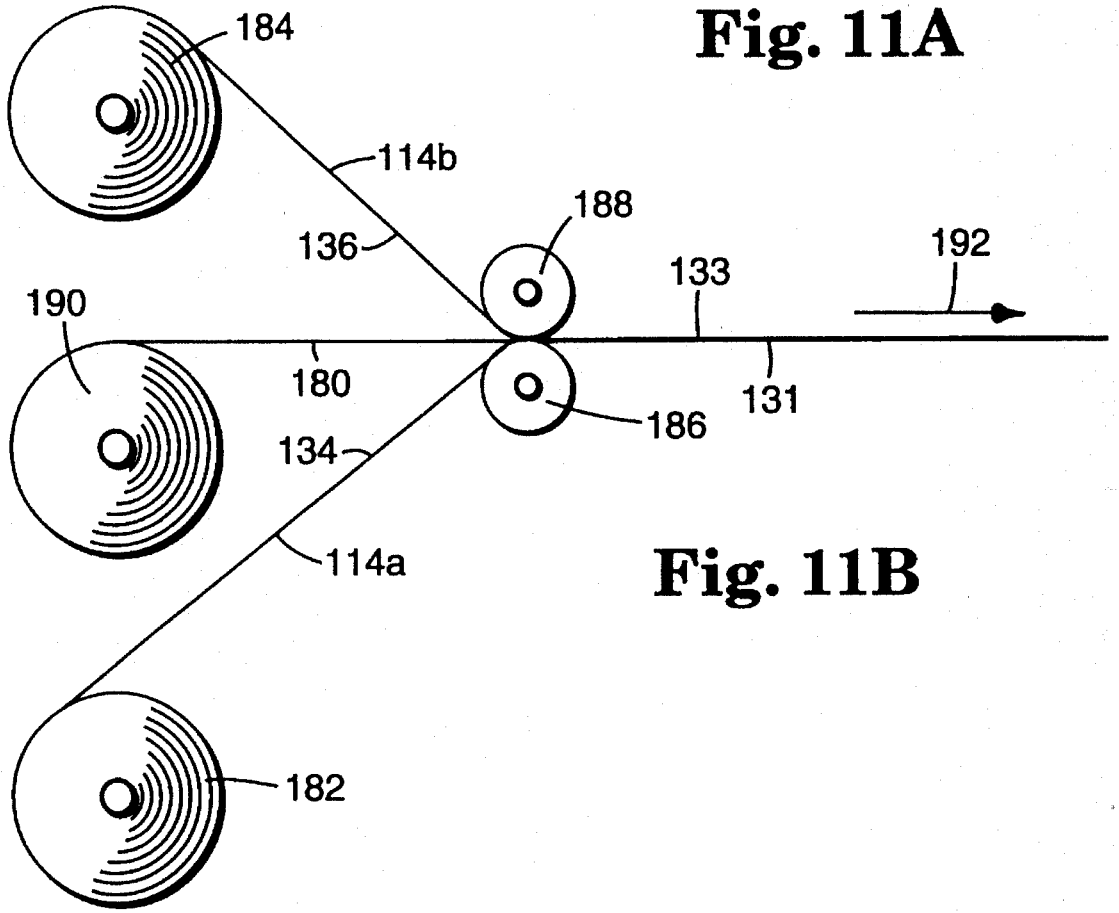
FIG. 11B is a schematic representation of a method and apparatus for constructing the application bands and removable liner in FIG. 11.

FIGS. 11A and 11B illustrates another alternate embodiment 110*a* of the present invention in which a release liner 180 is interposed between the pressure sensitive adhesive layers 134,136 of the application bands 114*a* and 114*b*. Preferably, the release liner 180 is coextensive with the pressure sensitive adhesive layers 134, 136 of the bands and facilitates the separation of the bands. Due to the difficulty that may be encountered in ultrasonic welding or heat bonding the application bands 114*a*, 114*b* through liner 180 to attach the application bands to the preformed bow member, other attachment means are preferred, such as sewing, mechanical staples (such as staple 118 in FIGS. 8 and 8A), clips or the like as described hereinelsewhere. Alternatively, the liner 180 may be interposed in discrete lengths, rather than continuously, between the application bands to avoid the point at which the application bands are attached to the preformed bow member.

Figure lib illustrates one embodiment of an apparatus and a method for constructing the prefabricated self-adhering bow of FIGS. 11 and 11A and includes supply rolls 182 and 184 for band webs 114*a*, 114*b*, respectively. The application band webs pass through nip rollers 186 and 188. Release liner web 180 is conveyed from supply roll 190 to nip rollers 186 and 188 in between application band webs 114*a*,114*b* to form a laminate that is conveyed in direction 192 and ultimately utilized to construct the prefabricated self-adhering bow 110*a* in a manner previously herein described.

In FIGS. 11 and 11A, the stiffening sheet 142 is interposed between the base portion and the application bands 114*a*, 114*b*. In the embodiment of the invention 110*b* shown in FIGS. 12 and 12A, the application bands are interposed between the base portion of the bow member and the stiffening sheet 142. In FIG. 12A, the application bands 114*a*, 114*b* have been separated and applied to an object, such as a gift package.

If application bands are provided that are the same length (as in FIGS. 8 and 8A, the lowermost application band 114*a* must be folded around the stiffening sheet, and thus present a shorter effective length to the package. In the embodiment of the invention 110*b* illustrated in FIGS. 12B and 12C, application bands 114*a* and 114*b* are provided in which the length of application band 114*a* has a greater length than the length of application band 114*b*, the additional length of application band 114*a* is sufficient to present effectively the same length of pressure sensitive adhesive coated application band to the object application band 114*b*, after the application bands have been separated and application band 114*a* has been folded around stiffening sheet 142

If the layer of pressure sensitive adhesive coated on the first major surface of application band 114*a* is co-extensive with the application band, then the portion of the application band 114*a* that extends beyond the second end of the application band 114*b* will have an exposed adhesive. Although not required, the exposed adhesive may be covered prior to use with a length of a removable liner 196, such as a silicone coated release liner (as shown in FIG. 12C). Alternatively, the exposed pressure sensitive adhesive may be masked by a deadening strip, coated with a masking layer or pattern coated to eliminate any adhesive in the exposed area. However, although these approaches eliminate the need for the removable liner, they provide an application band that is not adhered to the object adjacent the second end thereof.

Preferably, the liner is constructed to be co-extensive with the exposed portion of the application band. Most preferably, the ends of the application bands of the present invention in all embodiments described and claimed herein are "straight cut," i e. severed transversely to the longitudinal edges of the application bands, as shown in FIG. 12B.

Figure 12:
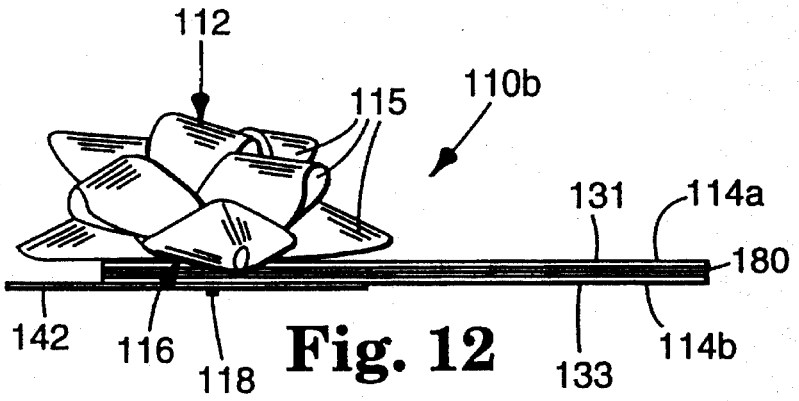
FIG. 12 is partial side view of another alternate embodiment of the preformed self-adhering bow of the present invention with the pressure sensitive adhesive coated application bands interposed between the stiffening sheet and the base portion of the bow.
Figure 12A:
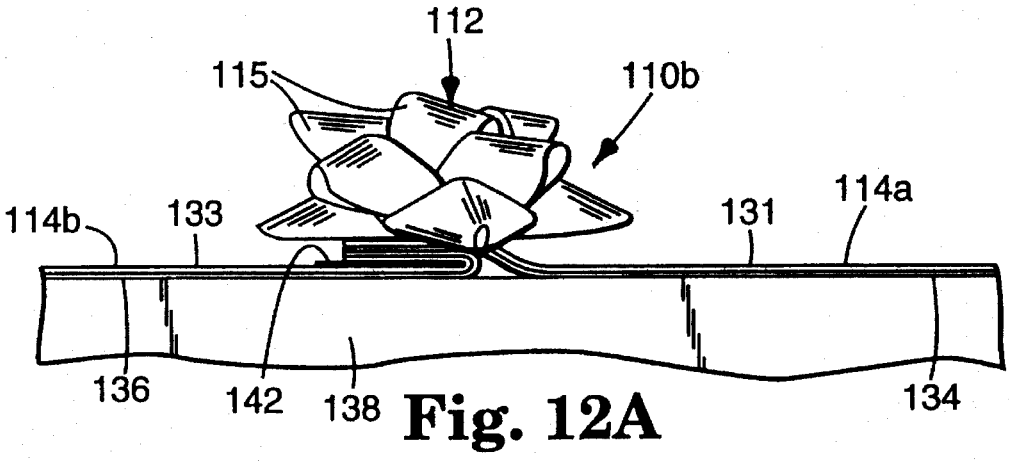
FIG. 12A is a partial side view of the bow of FIG. 12, with the application bands separated and applied to an object.
Figure 12B:
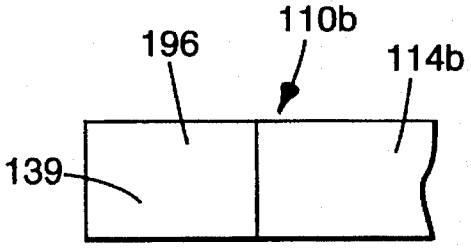
FIG. 12B is a magnified partial top view of the second ends of one embodiment of the application bands of FIGS. 12 and 12A wherein the bands have unequal lengths.
Figure 12C:
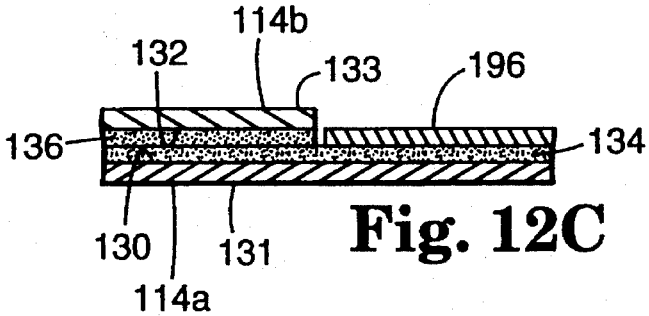
FIG. 12C is a magnified partial cross sectional view of the alternate embodiment of the application bands of FIG. 12B with a removable liner covering the exposed adhesive.
Figure 13:
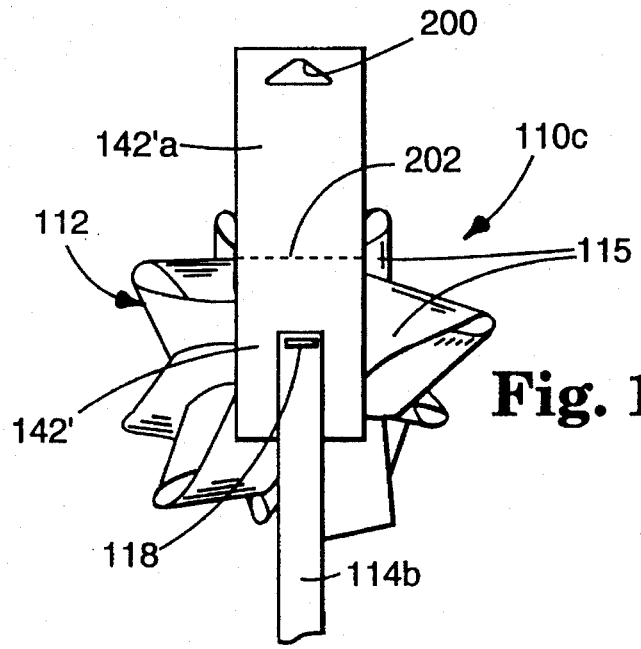
FIG. 13 is a bottom view of an alternate embodiment of the preformed self-adhering pull bow of the present invention wherein a portion of the stiffening sheet is detachable from the bow.

FIG. 13 illustrates yet another alternate embodiment 110*c* similar to the embodiment in either FIGS. 11 and 12 in which an optional stiffening sheet 142' is provided and attached to the base portion of the bow member, in either order with the application bands. However, in the preferred embodiment of the present invention, when a stiffening sheet 142' is included, the stiffening sheet preferably includes an aperture 200 or curved slot (not shown) to facilitate engaging the bow to a support structure, such as a projecting rod (not shown), as may be found useful in displaying the bow for sale.

The stiffening sheet may also be formed with a separation line 202. Preferably the separation line 202 is a perforated line. The separation line enables a portion 142'*a* of the stiffening sheet 142' to be divided and removed, such as just prior to applying the bow to an object, since the portion containing the aperture is no longer needed and may detract from the attractiveness of the bow. Of course, the aperture 200 may be employed without the separation line 202 and the separation line may be employed without the aperture, if desired.

Figure 14:
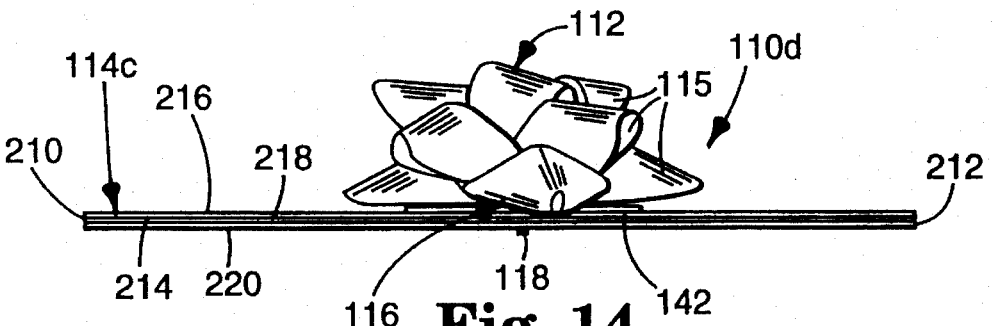
FIG. 14 is a side view of another alternate embodiment of the preformed self-adhering bow of the present invention including a stiffening sheet and a single application band having a pressure sensitive adhesive coating and a release liner attached at an intermediate location to a case portion of a preformed bow.
Figure 15:
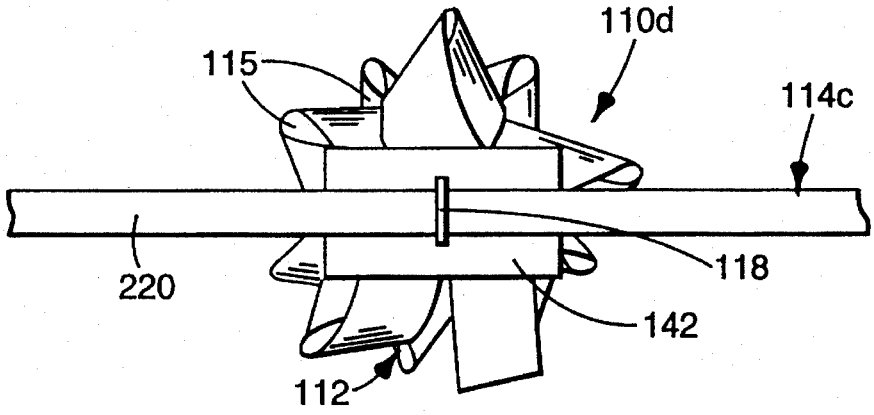
FIG. 15 is a bottom view of the preformed self-adhering bow of FIG. 14.

FIGS. 14 and 15 illustrate another alternate embodiment 110*d* of the invention in which a single application band 114*c* is provided. The single application band includes a first end 210 and a second end 212, a first major surface 214 and a second major surface 216. The first major surface 214 is coated with a layer of pressure sensitive adhesive 218, and most preferably a repositionable pressure sensitive adhesive, as herein described.

The single application band 114*c* is attached to the base portion 116 of the bow member 112 at an intermediate location, most preferably by staple 118, with the first major surface 214 facing away from the bow member. A removable release liner 220 is applied over the layer of pressure sensitive adhesive 218 prior to use. When the liner 220 is removed, the application band may be applied to an object, such as a gift package.

In the embodiment of the invention illustrated in FIGS. 14 and 15, a stiffening card 142 is incorporated, as previously described. The stiffening card 142 may be either interposed between the application band 114*c* and the bow member, or alternatively, the application band may be interposed between the stiffening card and the bow member.

Figure 16:
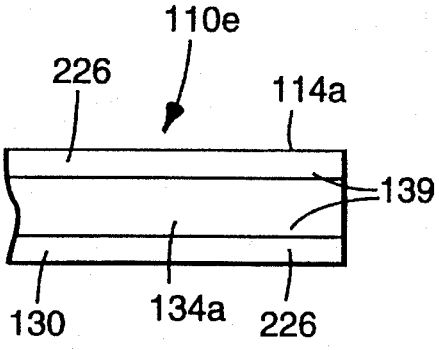
FIG. 16 is a magnified partial plan view of the second end of an application band with a layer of pressure sensitive adhesive having a width less than the width of the application band.

FIG. 16 illustrates yet another alternate embodiment 110*e* of the separating means of the present invention, in which the layer of pressure sensitive adhesive 134*a* is coated in a longitudinal strip having a width less than the width of the application band to which it is applied (only one of which is shown). This ensures that at least a portion of the facing surfaces of the application bands will not be adhered to each other. These non-adhered portions may be grasped and pulled apart to separate the application bands. Preferably, the longitudinal strip of pressure sensitive adhesive is medially located to provide parallel laterally spaced non-adhered longitudinal side strips 226 for the application bands.

Figure 17:
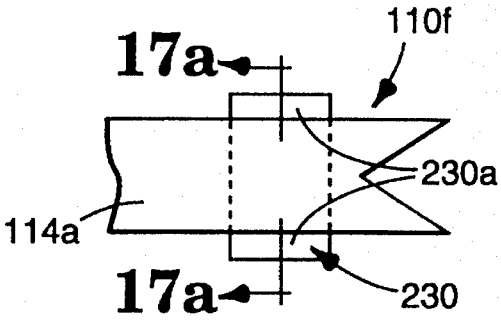
FIG. 17 is a magnified partial plan view of the second end of an application band with a tab mounted thereon.
Figure 17A:
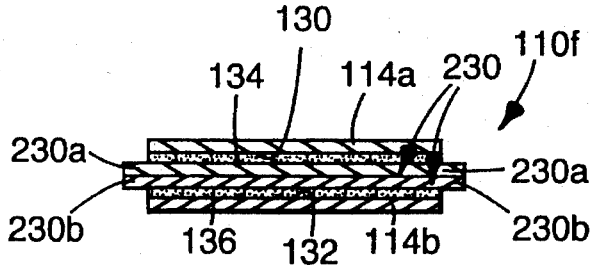
FIG. 17A is a magnified cross sectional view along plane 17A—17A of a pair of reciprocally adhered application bands having a tab mounted thereon according to the embodiment in FIG. 17.

FIGS. 17 and 17A illustrate another alternate embodiment 110*f* of the present invention in which a tab 230 is adhered to at least one and preferably a separate tab is adhered to both facing pressure sensitive adhesive layers 134 and 136 of the bands 114*a* and 114*b*. Each tab 230 includes a portion 230*a* that projects beyond the facing reciprocally adhered surfaces of the application bands. The projecting portions 230*a* of the tabs 230 may be grasped and pulled apart to separate the bands. It will be understood that both the tabs 230 may be permanently adhered to the application bands, or may be removable prior to use, similarly to the removable release liner 190 in the embodiment of the invention shown in FIGS. 11 and 11A.

Figure 17B:
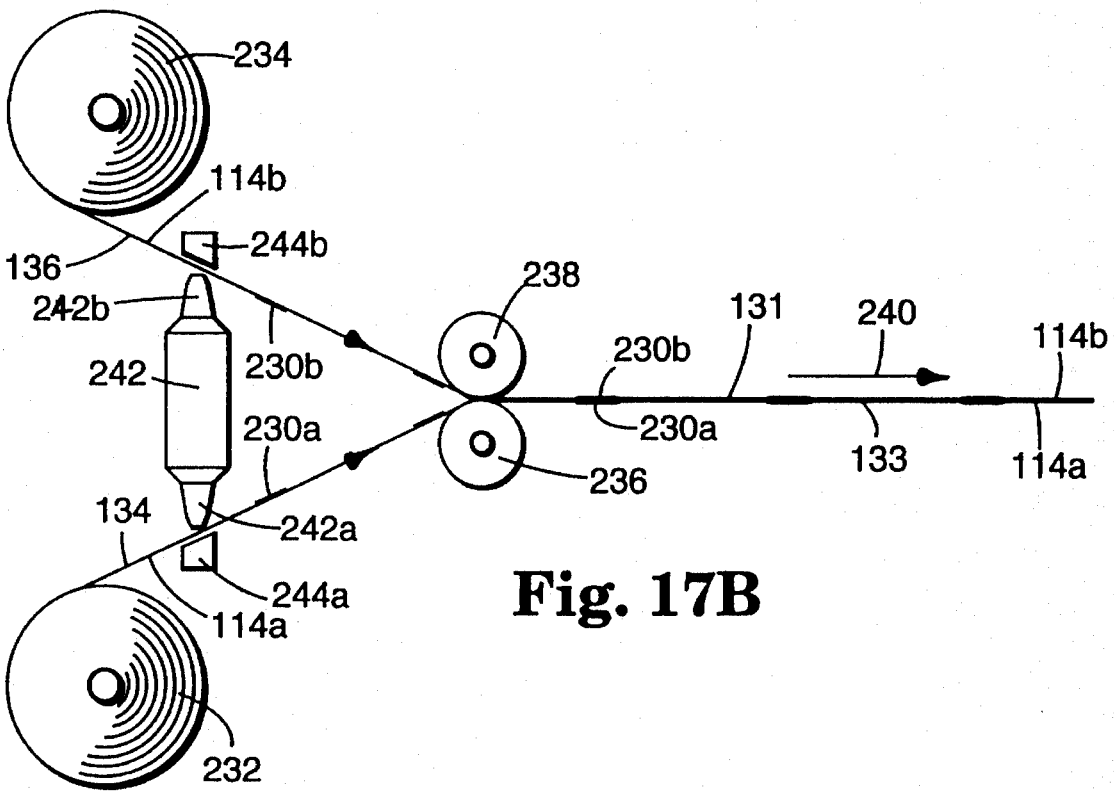
FIG. 17B is a schematic representation of a method and apparatus for applying tabs to the application bands of the bow of FIG. 17A.

FIG. 17B illustrates one embodiment of an apparatus and method for constructing the embodiment 110*f* of the present invention shown in FIGS. 17 and 17A. Application band webs 114*a* and 114*b* are drawn off of supply rolls 232 and 234, respectively. The application band webs 114*a*, 114*b* are brought together with their pressure sensitive adhesive coated sides 134,136 in contact at nip rollers 236 and 238 and thereafter are conveyed together in direction 240 for further construction of a prefabricated self-adhering bow as previously hereinabove described.

Means are provided to apply the tabs 230*a*, 230*b* to the pressure sensitive adhesive layers 134,136 of the application band webs 114*a*,114*b*. In the illustrated embodiment, the applicator means takes the form of tab applicator 242 situated in between application band webs 114*a* and 114*b*. The tab applicator 242 includes tabbing members 242*a* and 242*b* and aligned platens 244*a* and 244*b*. The tabbing members 242*a*, 242*b* are periodically actuated to apply a tab 230 to each of the application band webs, reinforced by the platens 244*a* and 244*b*. Preferably, the tabs 230*a*, 230*b* on both application bands are aligned when the application band webs 114*a*,114*b* are reciprocally adhered.

Figure 18:
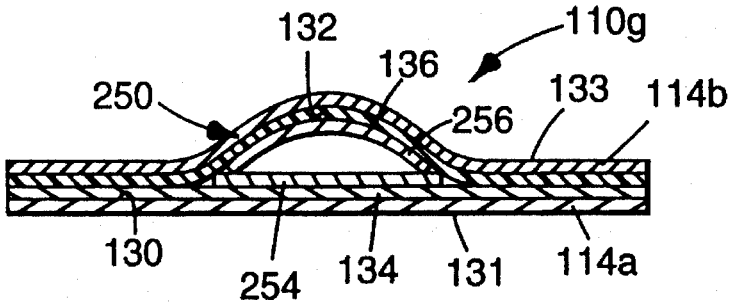
FIG. 18 is a magnified partial view of another alternate embodiment of the preformed self-adhering bow of the present invention in which the length of one application band is greater than the length of the other application band, and a loop is formed at an intermediate location in the application band having the greater length.

Yet another alternate embodiment 110*g* of the prefabricated self-adhering bow of the present invention is shown in FIG. 18. Prefabricated self-adhering bow 110*f* includes loop 250 adjacent second ends of the application bands 114*a*, 114*b*. The loop 250 facilitates manual engagement and separation of the bands. The portion of layers of pressure sensitive adhesive 134 and 136 of the application bands may, if desired, be covered with a release liner segments 254 and 256, respectively. Alternately, the portions of the bands forming loop 250 may be constructed without a pressure sensitive adhesive coating on aligned segments of major surfaces 130, 132.

Figure 18A:
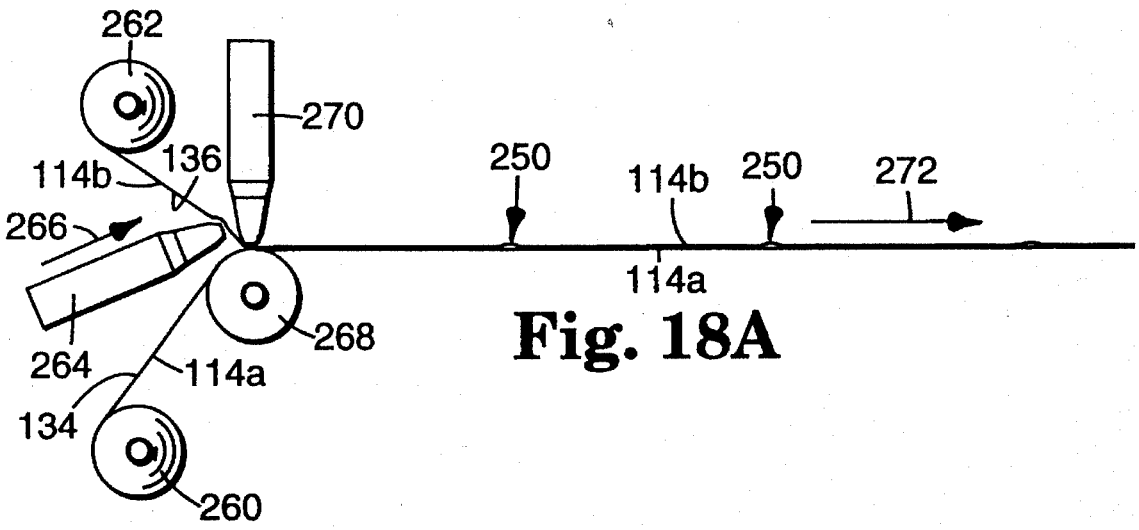
FIG. 18A is a schematic representation of a method and apparatus for forming the loop in a pair of reciprocally adhered application bands as shown in FIG. 18.

FIG. 18A illustrates one embodiment of apparatus and a method for constructing the prefabricated self-adhering bow 110*g* of FIG. 18. Application band webs 114*a* and 114*b* are pulled from supply rolls 260 and 262, respectively, with respective pressure sensitive adhesive layers 134, 136 facing each other. Loop forming member 264 is periodically actuated by a mechanism (not shown) to extend in direction 266 against band web 114*b*. The bands 114*a*, 114*b* are brought together at nip roller 268 and brushed together by platen 270 to reciprocally adhere into a projecting "tab" (not shown). The reciprocally adhered bands are conveyed in direction 272. Loops 250 are thus periodically formed in the reciprocally adhered bands webs conveyed in direction 272. This embodiment utilizes a greater length of band 114*b* than band 114*a* in forming the prefabricated self-adhering bow 110*f* of the present invention.

In the illustrated embodiment, liners 254, 256 may be applied to aligned positions on facing pressure sensitive adhesive coated surfaces 130,132 of the application bands webs at loop 250 in any convenient manner known in the art to facilitate separation of the application bands starting at the loop without forming a tab. Alternatively, once the loop 250 has been formed in application band 114*b*, the application band may be severed at the loop in order to form application band 114*b* with a length that is longer than the length of application band 114*a* (as in FIGS. 12B and 12C).

Figure 19:
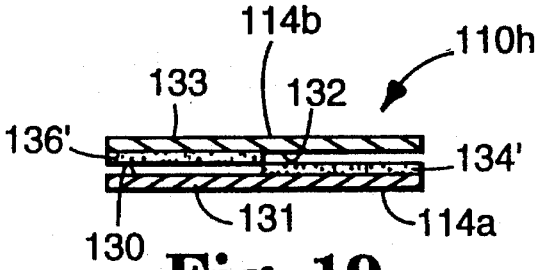
FIG. 19 is a magnified partial cross-sectional view of the application bands of another alternate embodiment of the preformed self-adhering bow of the present invention, wherein the layers of pressure sensitive adhesive are coated on offset portions of the facing surfaces of the application bands.

FIG. 19 illustrates another alternate embodiment 110*h* of the present invention in which the facing surfaces 130, 132 of the application bands 114*a*, 114*b* are coated with layers 134', 136' of pressure sensitive adhesive on offset portions. That is, the layers 134' 136' of pressure sensitive adhesive will not be in adhesive to adhesive contact when the application bands are brought together. Rather, the layers of pressure sensitive adhesive will adhere to an uncoated portion of the facing surface of the opposing application band. In the illustrated embodiment, the coated portions of the facing surfaces of the application bands are longitudinally extending strips on alternating sides of the bands.

One of the advantages of the embodiment 110*h* shown in FIG. 19 is that any suitable pressure sensitive adhesive may be employed, since the layers of pressure sensitive adhesive are not in direct contact. Further, suitable low adhesion coatings may be applied to the opposing portions of the application bands to limit the force required to separate the application bands to a desired level, yet provide a pressure sensitive adhesive that strongly adheres to a surface to which the bow is applied.

The present invention has now been described with reference to multiple embodiments thereof. It will be apparent to those skilled in the art that many changes can be made in the embodiments described without departing from the scope of the present invention. For instance, in any of the above embodiments, a portion of the facing surfaces of the application bands may rendered non-adhesive by applying a layer of a masking material, as is known in the art, over portions of the band that has been previously coated with a pressure sensitive adhesive. The masking material may take the form of a sheet of material or a liquid material that solidifies after application. Further, it may be desirable to pattern coat the pressure sensitive adhesive on the bands so that longitudinally spaced portions remain free of adhesive. The adhesive free portions would be aligned such as at the location 124 where the application bands are secured to each other and attached to the bow member. Thus, the scope of the present invention should not be limited to the structures described in this application, but only by structures described by the language of the claims and the equivalents of those structures.

What is claimed is:

1. A preformed self-adhering bow for application to an object, comprising:

(a) a preformed bow member including a plurality of bow loops interconnected by joining means at a base portion; and (b) a single flexible ribbon application band having a first end and an opposing second end, and a first major surface, with at least a portion of said first major surface of said application band having a layer of a pressure sensitive adhesive coated thereon; and (c) means for attaching said application band to said base portion of said bow member, said band being attached to said bow member at a location intermediate said first and said second ends thereof, with said layer of pressure sensitive adhesive on said first major surface being directed away from said bow member;

(d) said exposed layer of pressure sensitive adhesive on said first major surface of said application band for application to the object to adhere the bow to the object.

2. The preformed self-adhering bow of claim 1, wherein said layer of pressure sensitive adhesive on said application band is a repositionable pressure sensitive adhesive, wherein said bow may be removed from a package by detaching said pressure sensitive adhesive coated application band from the package without damage to the bow or the package.

3. A preformed self-adhering bow for application to an object, comprising:

(a) a preformed bow member including a plurality of bow loops interconnected by joining means at a base portion; and (b) a pair of flexible ribbon application bands, each having a first end and an opposing second end, and a first major surface, with at least a portion of said first major surfaces of said application bands having a layer of a pressure sensitive adhesive coated thereon; and (c) means for attaching said application bands to said base portion of said bow member adjacent the respective first ends thereof, with said respective first major surfaces in facing relationship and reciprocally adhered;

(d) wherein said application bands may be separated and the exposed layers of pressure sensitive adhesive applied to the object to adhere the bow to the object.

4. The preformed self-adhering bow of claim 3, further including a stiffening sheet mounted on said base portion of said bow member.

5. The preformed self-adhering bow of claim 4, wherein said stiffening sheet is interposed between said base portion and said application bands.

6. The preformed self-adhering bow of claim 4, wherein said application bands are interposed between said base portion and said stiffening sheet.

7. The preformed self-adhering bow of claim 3, wherein said attachment means includes a staple for attaching said application bands to said base portion of said bow member.

8. The preformed self-adhering bow of claim 3, further including means for separating said reciprocally adhered pressure sensitive adhesive coated first major surfaces of said application bands.

9. The preformed self-adhering bow of claim 8, wherein said separating means includes a weakened line in one of said application bands, said weakened line extending generally transversely across said width of said application band, wherein said one application band may be separated into two segments at said weakened line to facilitate separation of said application bands from each other.

10. The preformed self-adhering bow of claim 9, wherein said weakened line includes a transverse cut through said one application band.

11. The preformed self-adhering bow of claim 8, wherein said separating means includes one of said application bands having a length, from said attached first ends of said application bands, greater than the length of said other application band, whereby said second end of said longer application band extends beyond said second end of said other application band and may be grasped to separate said application bands from each other.

12. The preformed self-adhering bow of claim 8, wherein said separating means includes one of said application bands having a length, from said bonded first ends of said application bands, greater than the length of said other application band, whereby said application bands are reciprocally adhered to each other with a loop formed in said longer application band at an intermediate location extending away from said other application band, wherein said loop may be grasped to separate said application bands from each other.

13. The preformed self-adhering bow of claim 8, wherein said separating means includes a release liner interposed between said facing first major surfaces of said application bands enabling said application bands to be separated.

14. The preformed self-adhering bow of claim 8, wherein said separating means includes a tab adhered to one of said application bands and extending beyond said application band, wherein said tab may be grasped to separate said application bands from each other.

15. The preformed self-adhering bow of claim 8, wherein said separating means includes at least a portion of at least one of said first major surfaces of said application bands being free of pressure sensitive adhesive to enable the application bands to be separated at said pressure sensitive adhesive free portion.

16. The preformed self-adhering bow of claim 8, wherein said separating means includes aligned portions of said facing first major surfaces of said application bands are free of said pressure sensitive adhesive, wherein said application bands may be separated at said pressure sensitive adhesive free portions.

17. The preformed self-adhering bow of claim 16, wherein said pressure sensitive adhesive free portions of said facing surfaces of said application bands include laterally spaced, longitudinal side edges.

18. The preformed self-adhering bow of claim 16, wherein said pressure sensitive adhesive free portions of said facing first major surfaces of said application bands are located adjacent said second ends of said application bands.

19. The preformed self-adhering bow of claim 3, wherein said layers of pressure sensitive adhesive on said application bands are a repositionable pressure sensitive adhesive, wherein said bow may be removed from a object by detaching said pressure sensitive adhesive coated application bands from the object without damage to the bow or the object.

20. The preformed self-adhering bow of claim 19, wherein said repositionable pressure sensitive adhesive is a synthetic block copolymer.

21. The preformed self-adhering bow of claim 19, wherein said repositionable pressure sensitive adhesive is an acrylic adhesive.

22. The preformed self-adhering bow of claim 19, wherein said repositionable acrylic pressure sensitive adhesive is an acrylic microsphere adhesive.

23. A preformed self-adhering bow for application to an object, comprising:

(a) a preformed bow member including a plurality of bow loops interconnected at a base portion; and (b) a flexible ribbon application band having a first major surface and a second major surface, said first major surface is coated with a layer of a pressure sensitive adhesive, said application band being attached to said base portion of said bow member at an intermediate point with said second major surface facing said base portion;

(c) wherein said layer of pressure sensitive adhesive on said first major surface of said application band may be applied to the object to adhere the bow to the object.

24. The preformed self-adhering bow of claim 23, further including a removable liner covering said layer of pressure sensitive adhesive prior to application to the object to adhere the bow to the object.

* * * * *